US011384498B2

(12) United States Patent
Terata et al.

(10) Patent No.: US 11,384,498 B2
(45) Date of Patent: Jul. 12, 2022

(54) SLUICE GATE

(71) Applicants: Hiroshi Terata, Yokohama (JP); Hiroko Terata, Yokohama (JP)

(72) Inventors: Hiroshi Terata, Yokohama (JP); Hiroko Terata, Yokohama (JP); Shoko Kukita, Tokyo (JP); Keiichi Terata, Yokohama (JP); Yoko Terata, Yokohama (JP)

(73) Assignees: Hiroshi Tereta, Yokohama (JP); Hiroko Terata, Yokohama (JP)

( * ) Notice: Subject to any disclaimer, the term of this patent is extended or adjusted under 35 U.S.C. 154(b) by 3 days.

(21) Appl. No.: 15/762,183

(22) PCT Filed: Sep. 25, 2015

(86) PCT No.: PCT/JP2015/077164
§ 371 (c)(1),
(2) Date: Mar. 22, 2018

(87) PCT Pub. No.: WO2017/051481
PCT Pub. Date: Mar. 30, 2017

(65) Prior Publication Data

US 2018/0258600 A1 Sep. 13, 2018

(51) Int. Cl.
*E02B 7/20* (2006.01)
*E02B 3/10* (2006.01)
(Continued)

(52) U.S. Cl.
CPC ..... *E02B 7/44* (2013.01); *E02B 7/40* (2013.01); *E02B 7/50* (2013.01); *E02B 7/54* (2013.01)

(58) Field of Classification Search
CPC ... E02B 7/20; E02B 3/102; E02B 7/26; E02B 3/106; E02B 5/082; E02B 7/42;
(Continued)

(56) References Cited

U.S. PATENT DOCUMENTS 196,686 A * 10/1877 Marshall ..... E02B 7/44
405/102
610,548 A * 9/1898 Manny ..... E02C 1/00
405/85
(Continued)

FOREIGN PATENT DOCUMENTS

CN 201162208 Y 12/2008
CN 201722668 U 1/2011
(Continued)

OTHER PUBLICATIONS

Communication dated Apr. 1, 2019, from European Patent Office in counterpart application No. 15904738.0.
(Continued)

*Primary Examiner* — Edwin J Toledo-Duran
(74) *Attorney, Agent, or Firm* — Sughrue Mion, PLLC; Richard C. Turner

(57) ABSTRACT

In order to achieve a swing motion type retractable floodgate using a cost-effective torsion structure, the present invention is provided with a swing pivot support mechanism, a friction shoe, a door bottom support seat, and an operation step during a tidal flow. The support mechanism allows free rotation about three axes and restricts motion in the three axis directions, and a pulling force acts on the support mechanism. The friction shoe dissipates tidal energy during closing operations in a tidal flow to a level that prevents damage to the door. Reactive forces are endured by reducing impact forces with the flexibility and strength of the door bottom support seat. Suitable tidal energy dissipation is performed by selecting friction force strength in the operation step.

8 Claims, 12 Drawing Sheets

(51) Int. Cl.

| | |
|---|---|
| ***E02B 8/00*** | (2006.01) |
| ***E02B 7/44*** | (2006.01) |
| ***E02B 7/40*** | (2006.01) |
| ***E02B 7/50*** | (2006.01) |
| ***E02B 7/54*** | (2006.01) |

(58) Field of Classification Search

CPC . E02B 9/027; E02B 3/104; E02B 7/28; E02B 7/36; E02B 7/50; E02B 8/00; E04H 9/145

USPC ..... 405/71, 80–87, 90–92, 94, 95, 99, 100, 405/103–106; 49/10–12, 386; 52/302.1, 52/741.3; 160/123, 330; 454/275

See application file for complete search history.

(56) References Cited

U.S. PATENT DOCUMENTS 1,329,679 A * 2/1920 Sampson ..... E02B 7/205 137/428
1,334,354 A * 3/1920 Dodd ..... E02B 13/02 405/99
1,363,820 A * 12/1920 Sommer ..... E02B 7/205 405/97
1,422,076 A * 7/1922 Becher ..... E02B 7/42 405/100
1,593,306 A * 7/1926 Lawski ..... E02B 7/20 405/100
1,602,111 A * 10/1926 Jermar ..... E02B 7/205 405/101
1,648,535 A * 11/1927 Broome ..... E02B 7/54 405/104
1,920,698 A * 8/1933 Huguenin ..... E02B 7/40 251/298
1,938,675 A * 12/1933 Young ..... E02B 7/46 405/101
1,985,872 A * 12/1934 Schon ..... E02B 7/54 405/87
1,986,701 A * 1/1935 Zimmermann ..... E02B 7/54 49/470
2,009,234 A * 7/1935 Leonard ..... E02B 7/42 405/100
2,055,512 A * 9/1936 Wallace ..... F16K 3/0227 251/364
2,118,404 A * 5/1938 Jermar ..... E02B 7/48 405/102
2,139,458 A * 12/1938 Peilert ..... E02B 8/06 405/100
2,192,510 A * 3/1940 Smith ..... E02B 7/36 405/101
2,317,975 A * 5/1943 Boath ..... E02B 7/42 405/100
2,322,846 A * 6/1943 Growdon ..... E02B 7/42 405/93
RE22,745 E * 4/1946 Arne ..... E02B 7/50 405/101
2,529,141 A * 11/1950 Danel ..... E02B 8/06 405/108
2,551,678 A * 5/1951 Jermar ..... E02B 7/48 405/100
2,598,389 A * 5/1952 Jermar ..... E02B 9/025 405/94
2,621,484 A * 12/1952 Jermar ..... E02B 7/205 405/93
2,904,963 A * 9/1959 Lewin ..... E02B 7/42 405/97
2,909,899 A * 10/1959 Ramsden ..... E02B 7/42 403/81
2,966,777 A * 1/1961 De Brito ..... E02B 7/205 405/94
2,994,199 A * 8/1961 Herve ..... E02B 7/20 405/92
3,133,518 A * 5/1964 Burnett ..... E02B 7/50 114/45
3,221,504 A * 12/1965 Turner ..... E02B 7/205 405/96
3,316,934 A * 5/1967 Sowers ..... E04H 4/1272 137/578
3,331,208 A * 7/1967 Aubert ..... E02B 5/06 405/84
3,336,756 A * 8/1967 Isenberg ..... E02B 7/42 405/100
3,505,822 A * 4/1970 Schulz ..... E02B 7/42 405/100
3,543,521 A * 12/1970 Aubert ..... E02B 7/205 405/96
3,693,356 A * 9/1972 Mayo, Jr. ..... E02B 9/04 415/147
3,756,032 A * 9/1973 Solinas ..... E02B 7/44 405/92
3,925,999 A * 12/1975 Andrew ..... E02B 7/20 405/101
3,935,711 A * 2/1976 Sawai ..... E02B 7/44 405/100
4,073,147 A * 2/1978 Nomura ..... E02B 7/44 405/101
4,146,346 A * 3/1979 Salo ..... E02B 3/02 405/80
4,394,098 A * 7/1983 Wirschal ..... E02B 9/02 405/87
4,836,711 A * 6/1989 Sala ..... E02B 7/44 405/102
4,934,867 A * 6/1990 Cardis ..... E02B 7/54 405/101
4,963,057 A * 10/1990 Fournier ..... E02B 7/205 405/92
5,171,102 A * 12/1992 De Wit ..... E02B 7/54 405/101
5,178,490 A * 1/1993 Snowberger ..... E02B 7/44 405/102
5,199,812 A * 4/1993 McClellan ..... E02B 7/44 405/101
5,222,834 A * 6/1993 Schultz ..... E02B 7/44 405/102
5,433,555 A * 7/1995 Parizot ..... E02B 7/16 405/101
5,709,502 A * 1/1998 Obermeyer ..... B60C 15/02 405/91
6,287,050 B1 * 9/2001 Montgomery ..... F24F 11/76 52/573.1
6,623,209 B1 * 9/2003 Waters, Jr. ..... E02B 7/44 405/100
6,755,591 B1 * 6/2004 Rees ..... E02B 8/06 405/87
7,037,039 B1 * 5/2006 Werts ..... E02B 7/40 405/87
8,714,875 B2 * 5/2014 Morii ..... E02B 7/50 405/28
8,992,121 B2 * 3/2015 Cardis ..... E02B 7/20 405/99
9,783,946 B2 * 10/2017 Terata ..... E02B 7/38
9,970,170 B2 * 5/2018 Terata ..... E02B 8/04
2012/0034032 A1 * 2/2012 Waters, Jr. ..... E02B 3/104 405/92
2012/0163916 A1 * 6/2012 Waters, Jr. ..... E02B 7/50 405/112
2012/0163917 A1 * 6/2012 Waters, Jr. ..... E02B 3/102 405/114
2014/0193202 A1 * 7/2014 Arai ..... E06B 5/003 405/100
2014/0230328 A1 * 8/2014 Inui ..... E06B 9/00 49/11
2014/0328628 A1 * 11/2014 Nakayasu ..... E02B 3/104 405/26
2015/0218767 A1 * 8/2015 Terata ..... E02B 7/54 405/99
2016/0076268 A1 * 3/2016 Waters, Jr. ..... E06B 9/04 49/11

(56) References Cited

U.S. PATENT DOCUMENTS

| | | | | |
|---|---|---|---|---|
| 2017/0284047 | A1* | 10/2017 | Terata | E02B 7/38 |
| 2018/0258600 | A1* | 9/2018 | Terata | E02B 7/40 |
| 2019/0194894 | A1* | 6/2019 | Terata | E02B 7/26 |

FOREIGN PATENT DOCUMENTS

| | | | |
|---|---|---|---|
| DE | 19607076 | A1 | 8/1997 |
| EP | 0478817 | A1 | 4/1992 |
| JP | 50-016334 | A | 2/1975 |
| JP | 62-090420 | A | 4/1987 |
| JP | 2003-239263 | A | 8/2003 |
| JP | 2009-084883 | A | 4/2009 |
| JP | 2013-002250 | A | 1/2013 |
| WO | 2014/037987 | A1 | 3/2014 |

OTHER PUBLICATIONS

Hiroshi Terata et al., "Torsion Type Flap Gate for Docks," Mitsubishi Heavy Industries, Ltd. Technical Review, Nov. 1979, pp. 49-59 (23 pages total including translation), vol. 16, No. 6.

International Search Report of PCT/JP2015/077164 dated Dec. 8, 2015.

Communication dated May 6, 2020, from the China National Intellectual Property Administration in Application No. 201580083336.1.

* cited by examiner

FIG. 3
| Item | | Date | Unit | Note |
|---|---|---|---|---|
| Gate dimension | Span | 450 | m | ○○ Port Design A (Super Large Tidal Gate) (excluding steel weight.) |
| | Height | 23 | | |
| | Width | 12.5 | | |
| Hydrauric condition | Site depth | 16 | | |
| | Tide def. | 5 | | |
| | Free board | 2 | | |
| Steel weight (rough estimation) | Gate leaf | 18000 | th | |
| | Embedded part | 1500 | | |
| | Machine | 500 | | |
| | Total | 20000 | | |
FIG. 4A
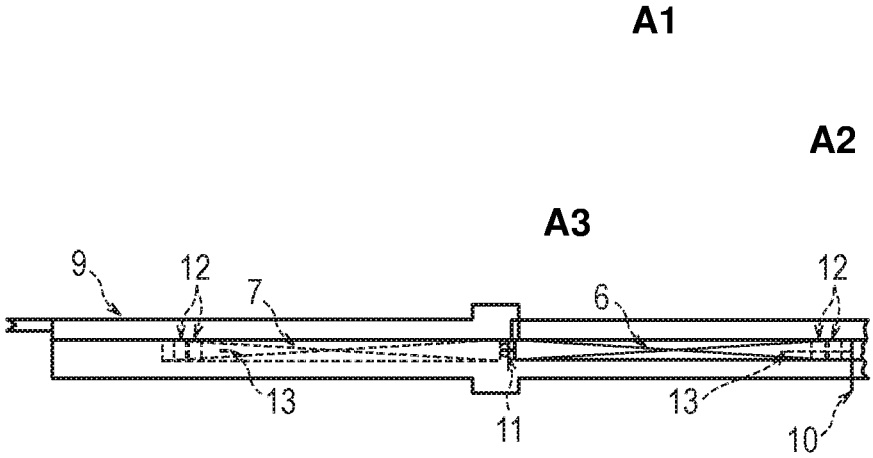
FIG. 4B
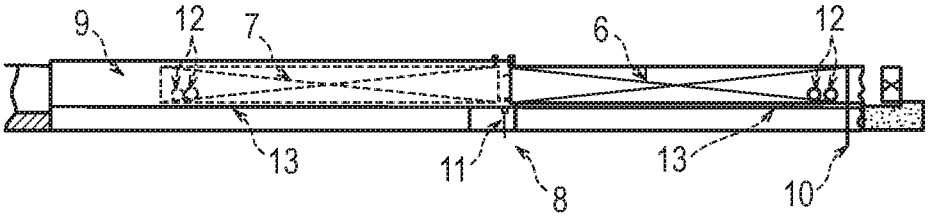

FIG. 5
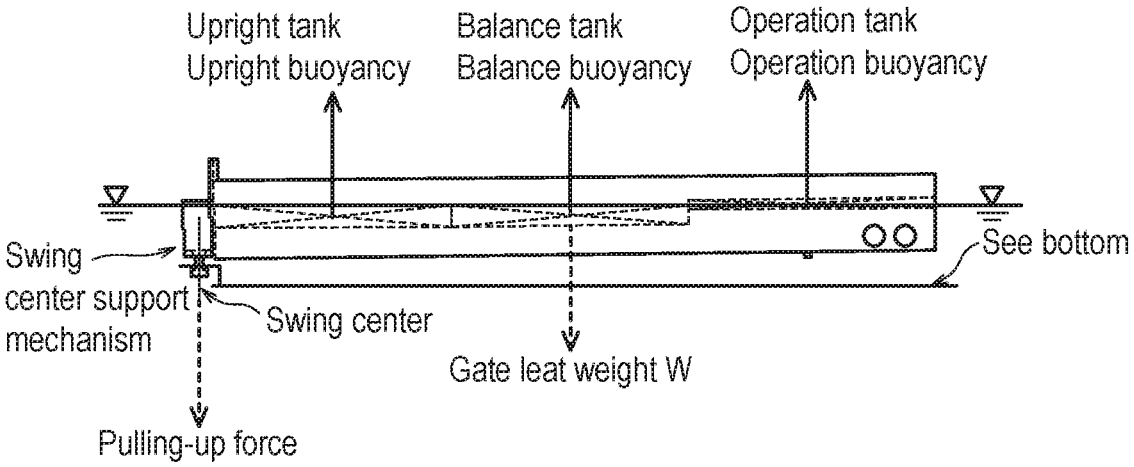
FIG. 6
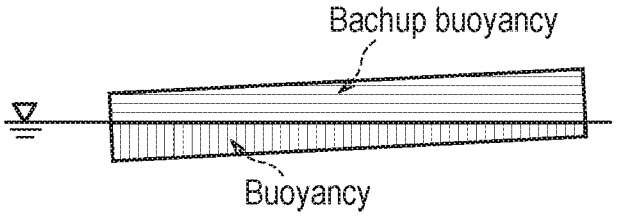
FIG. 7
| Calculation item | | Gate leaf regio | | | | | Total |
|---|---|---|---|---|---|---|---|
| | | Upright tank | Blance tank | Operation tank | Swing center | Gravity center | |
| Tank capacity(m3) | | 5408 | 5408 | 2200 | – | – | 13016 |
| Acting force | Backup buoyancy(tf) | 0 | 0 | 1126 | – | – | 1126 |
| | Bbuoyancy(tf) | 5408 | 5408 | 1074 | – | – | 9000 |
| | Pulling force S(tf) | – | – | – | 2890 | – | |
| | Gate leaf weight W(tf) | – | – | – | – | 9000 | 9000 |

FIG. 8B
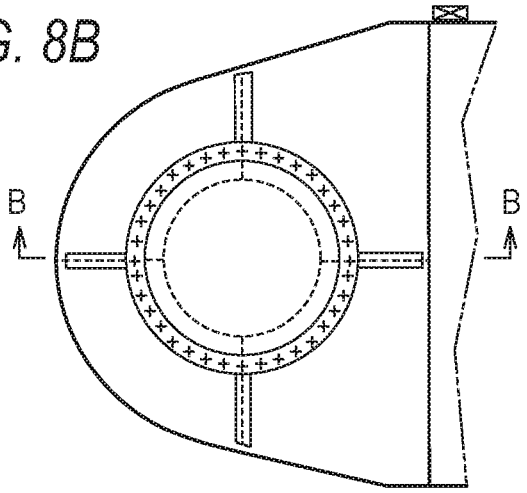
FIG. 8A
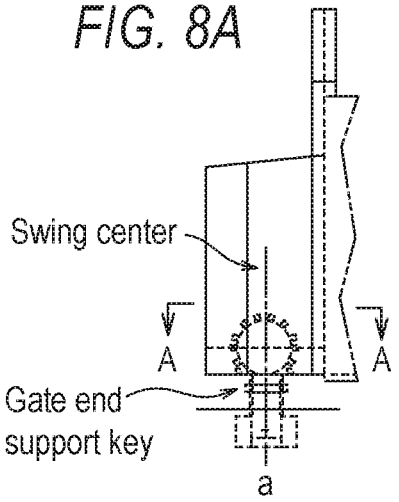
FIG. 8C
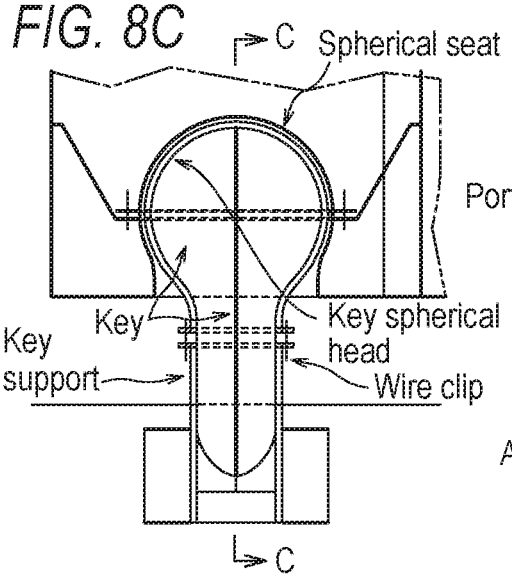
FIG. 8D
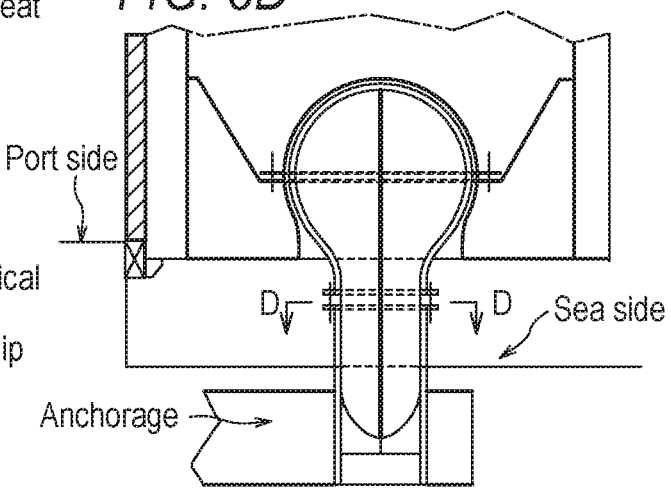
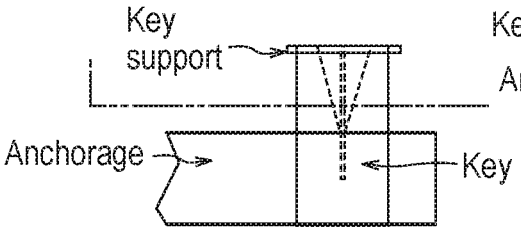
FIG. 8F
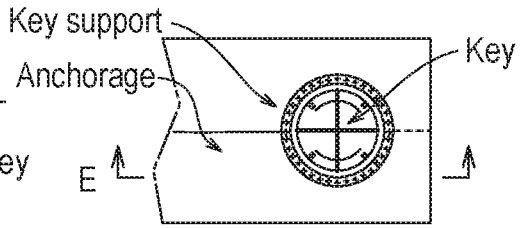
FIG. 8E FIG. 9A
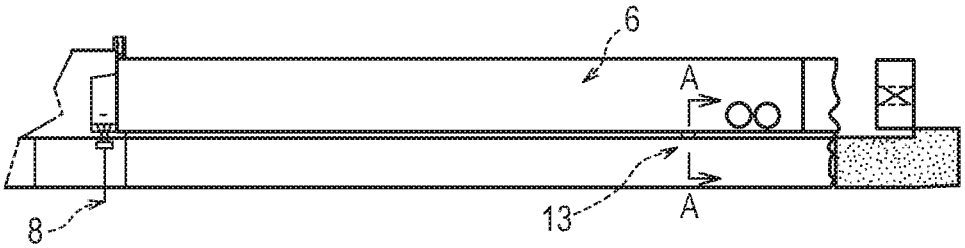
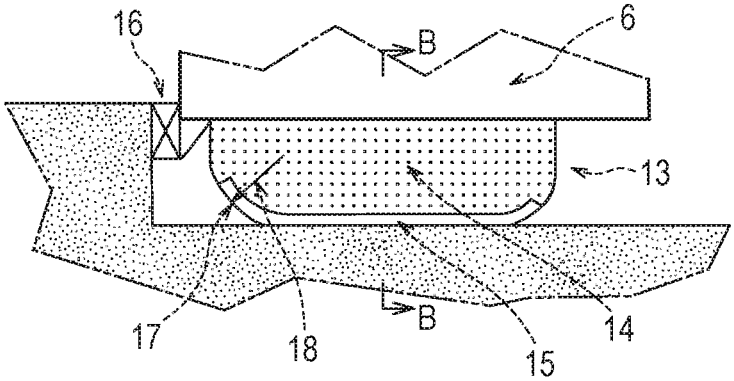
FIG. 9B
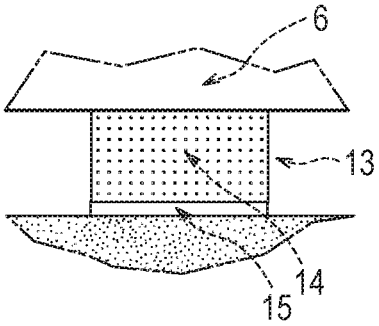
FIG. 9C

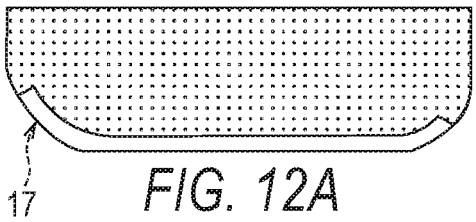
FIG. 12A
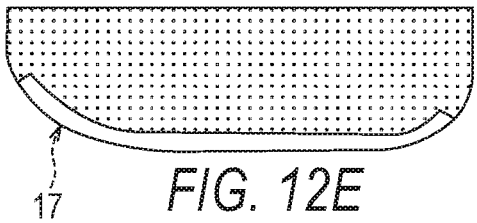
FIG. 12E
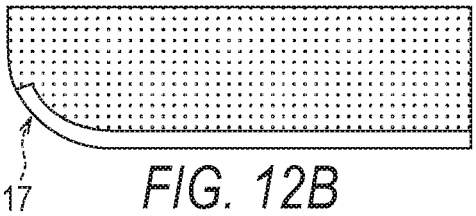
FIG. 12B
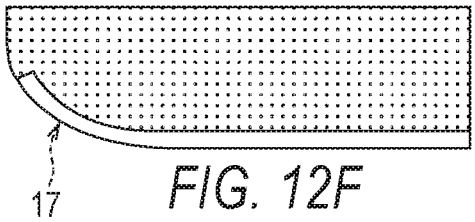
FIG. 12F
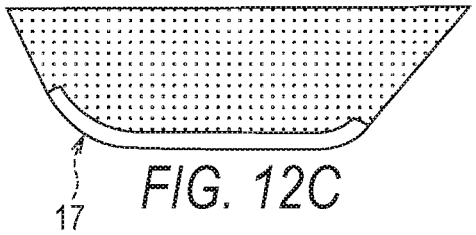
FIG. 12C
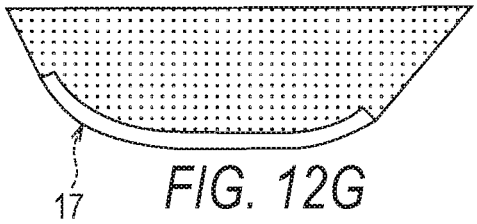
FIG. 12G
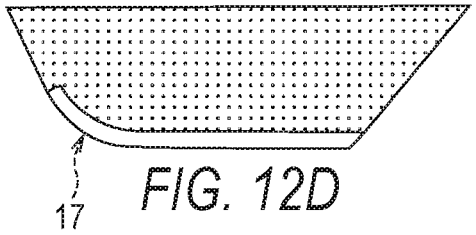
FIG. 12D
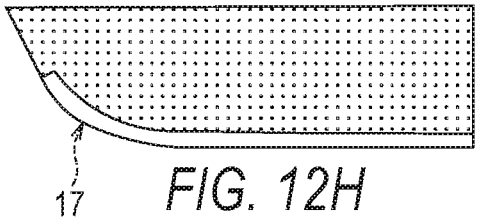
FIG. 12H
| Combination items for shoe tread form | | Figure mark | | | | | | | |
|---|---|---|---|---|---|---|---|---|---|
| | | a | b | c | d | e | f | g | h |
| Bent side | Both ends | ○ | | ○ | | ○ | | ○ | |
| | One end | | ○ | | ○ | | ○ | | ○ |
| End wall form | Vertical | ○ | ○ | | | ○ | ○ | | |
| | Inclined | | | ○ | ○ | | | ○ | ○ |
| Bent form | Circular arc | ○ | ○ | ○ | ○ | | | | |
| | Free curve | | | | | ○ | ○ | ○ | ○ |
Shoe tread form combination
FIG. 12I

| Side thruster | | | | | Control limit | |
|---|---|---|---|---|---|---|
| Case No. | Thrust tf | kw | Number of unit | Total thrust | V. cm/s | Tide dif. cm |
| 1 | 40 | 2680 | 1 | 40 | 66.0 | 2.2 |
| 2 | 50 | 3350 | 1 | 50 | 73.8 | 2.8 |
| 3 | 60 | 4000 | 1 | 60 | 80.8 | 3.3 |
| 4 | 40 | 2680 | 2 | 80 | 93.3 | 4.4 |
| 5 | 50 | 3350 | 2 | 100 | 104.3 | 5.6 |
| 6 | 60 | 4000 | 2 | 120 | 114.3 | 6.7 |

FIG. 15

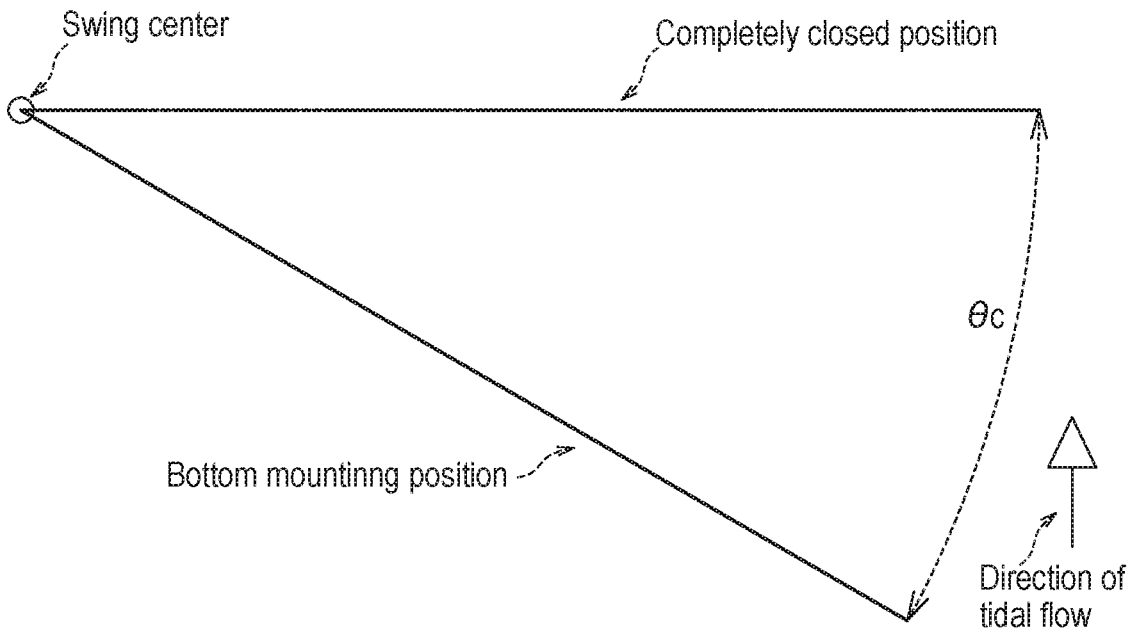

FIG. 16

Gate leaf closing operation steps

1. Travel to a bottom mounting position with help of a side thruster
2. Bottom mounting after operation buoyancy is set
3. Travel with help of tidal flow(Gate body tip speed < allowable limit)
4. Arrival at a gate completely closed position
5. Confirming a gate body tip position
6. Exhausting operation buoyancy
7. Side thruster shutdown
8. Setting gate levitation prevent apparatus on

SLUICE GATE

CROSS REFERENCE TO RELATED APPLICATIONS

This application is a National Stage of International Application No. PCT/JP2015/077164 filed Sep. 25, 2015.

TECHNICAL FIELD

The present invention relates to a sluice gate installed in a sluice for water flow or ships. The gate accommodates high tide water, tsunami, high water (reverse flow from a main river to a tributary stream), ocean waves, flood wood flow etc.

BACKGROUND ART

A large scale gate provided against high tide water, tsunami etc. is well known.

A flap gate whose gate leaf is a thin shell closed section (torsion structure) is one of gate types used for sluice gates. Although the gate leaf is, in general, supported by a foundation ground via axle type supports and rotates around the axles, some gate leaf is supported directly by a water bottom concrete structure and this supporting system is simple in structure and very advantageous in cost (Non-Patent Document 1, Patent Document 1).

FIG. 1 is a section which shows an example of the flap gate which is supported by the concrete structure.

Reference numeral 1 denotes a gate leaf (solid line, in a closed state). 2 denotes the gate leaf (dotted line, in an opened state), 3 denotes a rotation center of the gate leaf 1, 4 denotes a concrete structure, and 5 denotes a wood seat.

The wood seat 5 is fixed on the gate leaf 1 and 2.

When the gate is not in use, the gate leaf (in an open position) 2 is stored horizontally underwater as the dotted line shows. When in use, the gate leaf (in its open state) 2 rotates around the rotation center 2, rises up, and moves to the position of the gate leaf (in its closed state) 1 of the solid line and is supported by the concrete structure 4 via the wood seat 5.

A swig movement type is the well known type of gate open and closure procedure and the structural advantage of flap gate described at [0003] can be used by this type.

FIG. 2 shows the swing movement type of a open and closure type tidal sluice gate. FIG. 2 shows the left half of the tidal sluice gate viewed from a sea side. FIG. 2A is a plan. FIG. 2B is an elevation.

6 denotes a gate leaf in a completely closed state. 7 denotes a gate leaf in a completely opened state. The sluice gate of FIG. 2 is in either state 6 or 7.

8 denotes a swing center of the gate leaf 6, 9 denotes a storage pier of the gate leaf 7, and 10 denotes a center line of the tidal sluice gate.

The gate leaf 7 in the completely opened state is tied up at the storage pier 9. When in use, the hydraulic gate door (in its open state) 7 swings around the swing center 8 and moves to the position of the gate leaf (in its closed state) 6.

PRIOR ART DOCUMENTS

Patent Documents

Patent Document 1: JP S50-16334A
WO 2014/037987 A1 Patent Document 2:

Non-Patent Documents

Non-Patent Document 1: Hiroshi Terata, Noriaki Shigenaga. Torsion type flap gate for docks, Mitsubishi Heavy Industries, Ltd. TECHNICAL REVIEW June, 1980

DISCLOSURE OF THE INVENTION

Problems to be Solved by the Invention

Although the torsion structure has an overwhelming advantage in cost, its application to a gate has been limited to a flap gate that is fixed on the foundation ground via axle type supports. This invention enables application of the torsion structure to, for instance, a tidal gate that moves in a swing motion and makes the overwhelming advantage of torsion structure even higher. The application is also applicable to a super large tidal gate having a structure support span between 200 to 600 m and more.

This invention shows resolutions to the following problems, contributing to implementation of a swing movement type tidal gate of the torsion structure.

Problem 1: Gate leaf stability at gate mounting on a water bottom

Problem 2: Gate leaf motion at gate open and closure operation

Problem 3: Gate leaf operation with the help of tidal flow

Problem 4: Reaction force and impact force on a gate leaf bottom support seat

Problem 1: Gate Leaf Stability at Gate Mounting on a Water Bottom

When in use, the gate leaf tied up at the storage pier moves to the gate totally closed position by a swing motion. The gate leaf is in the state of floating on water during swing movement and provides a stability function which follows a stability theory of ship. The gate leaf at the completely closed position mounts on a water bottom after exhausted its buoyancy by water filling into its buoyancy tank. A stability function of the gate leaf in a bottom mounting state may disappear and the gate leaf would turn over on the water bottom if it happened.

Problem 2: Gate Leaf Motion at Gate Open and Closure Operation

Opening and closing in wild weather ocean waves is one of important operation conditions of a tidal sluice gate in-service. As the gate leaf in swing movement is in the state of floating on water, it pendulums just like a ship in ocean waves. Main elements of the pendulum is rolling, pitching and dipping. It is not preferable to restrict all the elements by the swing center since the restriction brings periodic constraint forces which is not favorable for structural strength.

Problem 3: Gate Leaf Operation with the Help of Tidal Flow

It is inevitable that gate leaf operation is made in the state of tide difference existence on both sides (sea side and port side) of the gate leaf. Gate leaf operation would not have any problems when the difference is so small that gate leaf control may be possible by on-board thruster machines (side thruster) or tug-boats etc. Completely closing operation will be made with the help of tide elevation on the sea side after the gate leaf is mounted on a water bottom within the gate controllable range of swing angle when gate closing operation is carried out with the tide difference much more than the difference previously mentioned. And, opening operation with the help of tide level on port side is possible. Problems on the gate leaf operation with the help of tidal flow are (3.1) Gate leaf lateral inclination and (3.2) Impact energy. Each problem is explained in the following.

(3.1): Gate Leaf Lateral Inclination

The gate leaf is in the state of water bottom mounting during open and closure operation with the help of tide difference and friction force works on the mounting surface as the gate leaf removes. The gate leaf yields big lateral inclination due to rotation moment composed by the tide difference and the friction force whose directions are cross each other. The gate leaf mounted on a water bottom may turn over because of stability function disappearance.

(3.2): Impact Energy

Completely closing operation is made with the help of tide elevation on the sea side after the gate leaf is mounted on a water bottom within the gate controllable range of swing angle when gate closing operation is carried out with the tide difference which is so big that gate leaf control may be impossible by on-board thruster machines (side thruster) or operation tug-boats etc. The gate leaf starts to remove pushed by the tide level on sea side, arrives at the completely closed position with gradually increasing speed and hits a water bottom concrete structure. The impact energy is the kinetic energy accumulated in the gate leaf while the gate leaf is removing from the bottom mounting position to the completely closed position and there may be a possibility of damaging the gate leaf and the water bottom concrete structure if the hit force glows big with too much the kinetic energy Problem 4: Reaction Force and Impact Force on a Gate Leaf Bottom Support Seat When gate leaf closing operation is made in tidal flow a bottom support seat on the gate leaf hits a water bottom concrete structure and impact force caused by the gate leaf rotation initiation works on the seat besides reaction force of gate leaf inertia force. It is necessary that damage of the seat due to the reaction force and the impact force are averted.

Means of Solving the Problems

A sluice gate which is equipped with a swing center support mechanism, a friction shoe/shoes and a gate leaf bottom support seat and operation steps in tidal flow are proposed to implement a opening/closing gate which is equipped with costly advantageous torsion structure and removes in swing motion. The support mechanism is rotation free and moving constraint in three axes directions and subject to pulling-up force. The friction shoe dissipate tidal energy so that gate damage may be averted. The gate bottom support seat provides flexibility and high strength together so that it may decrease the impact power and endure the reaction force. Appropriate dissipation of tidal energy will be carried out by a friction force strength selection in the operation steps.

Alternatively, a swing center support mechanism may be rotation free in two axes directions and moving constraint in three axes directions.

BRIEF DESCRIPTION OF DRAWINGS

FIG. 3 is an example of tidal sluice gate planning data.

FIG. 4 is an overall view of Embodiment 1 and is an embodiment of a swing movement type hydraulic gate door.

FIG. 5 illustrates a float tank arrangement and gate leaf acting forces of FIG. 4.

FIG. 6 is a detail drawing of operation tank of FIG. 5 and illustrates partition of a buoyancy and a backup buoyancy FIG. 7 is calculated results of FIG. 5 and FIG. 6.

FIG. 8 an explanatory drawing of a swing center mechanism in Embodiment 1.

FIG. 9 is a detail drawing of a friction shoe in Embodiment 1.

FIG. 12 is an example of friction shoe bottom fashions.

FIG. 15 is a plan of installation site where a gate leaf of Embodiment 1 is operated with the help of tidal flow.

FIG. 16 illustrates steps of the operation in tidal flow of Embodiment 1.

EMBODIMENTS OF THE INVENTION

FIG. 3 is an example of tidal sluice gate planning data.

Embodiment 1

FIG. 4 is an example based upon the data of FIG. 3 and illustrates a swing movement type tidal sluice gate. FIG. 4 illustrates the left half of the tidal sluice gate viewed from a sea side. FIG. 4A is a plan. FIG. 4B is an elevation.

Figure 1:
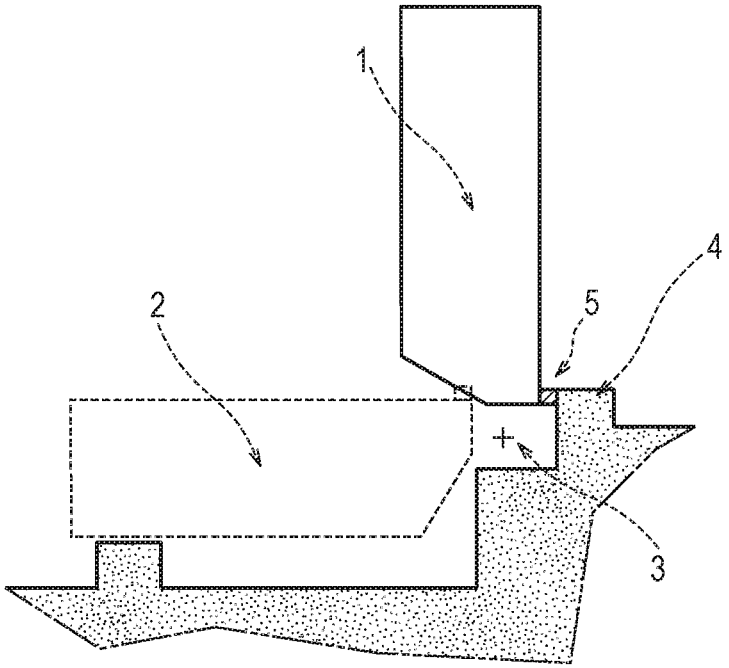
FIG. 1 PRIOR ART
FIG. 1 illustrates an example of a torsion structure flap gate supported by a water bottom concrete structure.
Figure 2A:
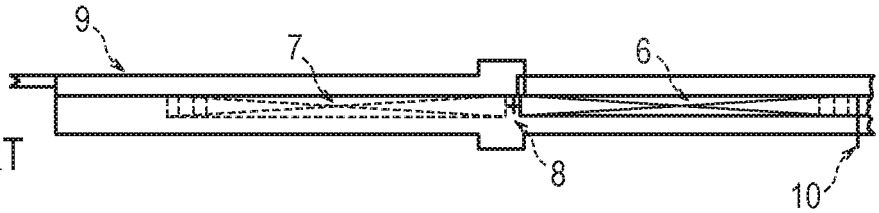
FIG. 2A PRIOR ART
FIG. 2 is an explanatory drawing of a swing movement type.
Figure 2B:
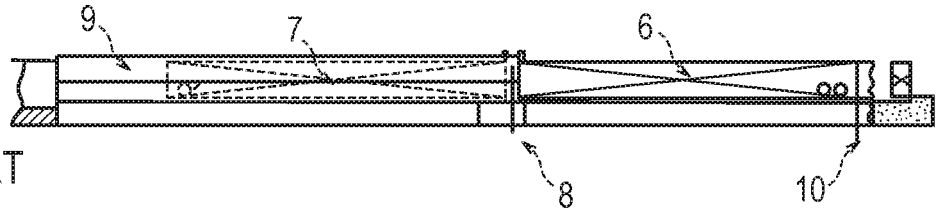
FIG. 2B PRIOR ART

6 denotes a gate leaf in a completely closed state. 7 denotes a gate leaf in a completely opened state. The sluice gate of FIG. 2 is in either state 6 or 7.

8 denotes a swing center of the gate leaf 6, 9 denotes a storage pier of the gate leaf 7, 10 denotes a center line of the tidal sluice gate. 11 denotes a swing center support mechanism, 12 denotes side thrusters, and 13 denotes a friction shoe.

The gate leaf 7 in the completely opened state is tied up at the storage pier 9. When in use, the gate leaf (in its open state) 7 moves by swing motion around the swing center 8 to the position of the gate leaf (in its closed state) 6 and mounts on a water bottom after exhausted its buoyancy.

FIG. 5 is the gate leaf 7 in swinging motion of FIG. 4 and illustrates float tank arrangement and acting forces of the gate leaf 7. FIG. 6 is a detail drawing of the operation tank on FIG. 5 and illustrates partition of a buoyancy and a backup buoyancy.

The tank arrangement of FIG. 5 includes three kind of tanks which ara an operation tank, a balance tank and a upright tank and the acting force of FIG. 5 includes 5 kind of forces which are operation buoyancy, balance buoyancy, upright buoyancy, gate leaf weight W and pulling-up force S and the gate leaf 7 of FIG. 4 floats on water by the operation tank backup buoyancy of FIG. 6. Role of each tank is as following.

Upright tank: Maintenance of gate leaf uprightness by coupled with the pulling-up force S Balance tank: Downsizing the operation tank by balanced with majority of the gate leaf weight Operation tank: Downwelling/surfacing operation of the gate leaf by filling/draining water in it FIG. 7 is a calculation result of the acting forces and the tank capacity which are shown on FIGS. 5 and 6. The calculation result is an estimate including assumptions that steel displacement is negligible, the buoyancy works upon each float tank center, flee surface effect of the tanks is negligible, and specific weight of water equals 1. Center height of the balance tank and the upright tank approximately coincide with the gate leaf gravity height. As the both tanks always submerge, their backup buoyancy is zero and the gate leaf in swing motion floats on water surface only with the backup buoyancy of the operation tank accordingly. Water of the same quantity as the backup buoyancy (1126 tf) is poured into the operation tank after gate leaf 7 of FIG. 4 arrives at the position of the gate leaf 6 in completely closed state, then the tank buoyancy in FIG. 7—the pulling-up force S=9000 tf which consorts with the gate leaf weight W. If the gate leaf 7 is softly pushed down in this instant of time a free end of the gate leaf 7 starts to sink, the friction shoe 13 on FIG. 4 arrives at a water bottom (the bottom mounting), and the gate leaf 7 is fit in the position of the gate leaf 6 on FIG. 4. A load of the friction shoe 13 in this state is zero. The load of friction shoe 13 becomes 1074 tf when additional water quantity poured into the operation tank arrives at the tank buoyancy (1074 tf). As overturn moment of the gate leaf 6 at this time is linear to the shoe load and upright moment is linear to the pulling-up moment S, a safety factor becomes about 2.7 and overturn of the gate leaf 6 will be avoided (corresponding to previously mentioned "Problem 1: Gate leaf stability at gate mounting on a water bottom").

The swing center support mechanism 11 of FIG. 4 is a support point fixed on a water bottom, whose support condition is rotation free and moving constraint in three axes directions A1, A2, and A3 and always subject to pulling-up force. FIG. 8 illustrates an example which satisfies this support condition. FIG. 8A is an elevation of the swing center mechanism 11. FIG. 8B is AA section of FIG. 8A. FIG. 8C is BB section of FIG. 8B. FIG. 8D is CC section of FIG. 8C. FIG. 8E is DD section of FIG. 8D. FIG. 8F is EE section (metals) of FIG. 8E. The gate end support key of FIG. 8A is the functional heart of the swing center support mechanism 11 and FIG. 8B thru FIG. 8F show details of the gate end support key. A section of the key of FIG. 8C is an across shape which is shown on FIG. 8E and the upper half of it composes a key spherical head which is shown on FIG. 8C. A key support is fixed to a anchorage embedded in a sea bottom concrete that is shown on FIG. 8F, the lower half of the key is inserted into the key support that is shown on FIG. 8C, and they are joined together with wire clips. The key spherical head fixed to a sea bottom as described above is covered by a spherical seat fitted on the gate leaf side as shown on FIG. 8C. The inside of the spherical seat and the outside of the key spherical head work as bearing surfaces and they facilitate load carrying function and sliding function. The lower half of the spherical seat is fixed by welding to the gate leaf side and the upper half of it is removable fitting of bolts out of a maintenance need. The lower half of the spherical seat is usually subject to the pulling-up force S which works upward.

Support condition of the swing center support mechanism 11 on FIG. 4 is rotation free and moving constraint in three axes directions. On the other hand, pendulum of the gate leaf during its swing motion in ocean waves is rolling, pitching, dipping etc. The pendulum motion of the gate leaf has a rotation element and a removing element at a support point of the swing center support mechanism 11. Although the removing element is restricted by the support point of the three axes direction moving constraint, the rotation element is not restricted by the support point of the three axes direction rotation free and impact of the gate leaf pendulum on its structural strength will be remarkably mitigated (corresponding to previously mentioned "Problem 2: Gate leaf motion at gate open and closure operation").

FIG. 9 is a detail of the friction shoe 13 on FIG. 4. FIG. 9A is an enlarged view of the gate leaf (solid line, in a closed state) 6. FIG. 9B is AA section of FIG. 9A. FIG. 9C is BB section of FIG. 9B.

Reference numeral 6 denotes a gate leaf, 8 denotes a swing center. 13 denotes a friction shoe, 14 denotes an upper of the friction shoe 13, 15 denotes a wear-resistant material covering a tread of the friction shoe 13, 16 denotes a bottom support seat (water sealing) or the gate leaf 6, 17 denotes a tip of the wear-resistant material 15, and 18 denotes an are radius of the tip 17.

The tip 17 of the wear-resistant material 15 covering a tread of the friction shoe 13 which is shown on FIG. 9B composes an are of the radius 18.

Figure 10:
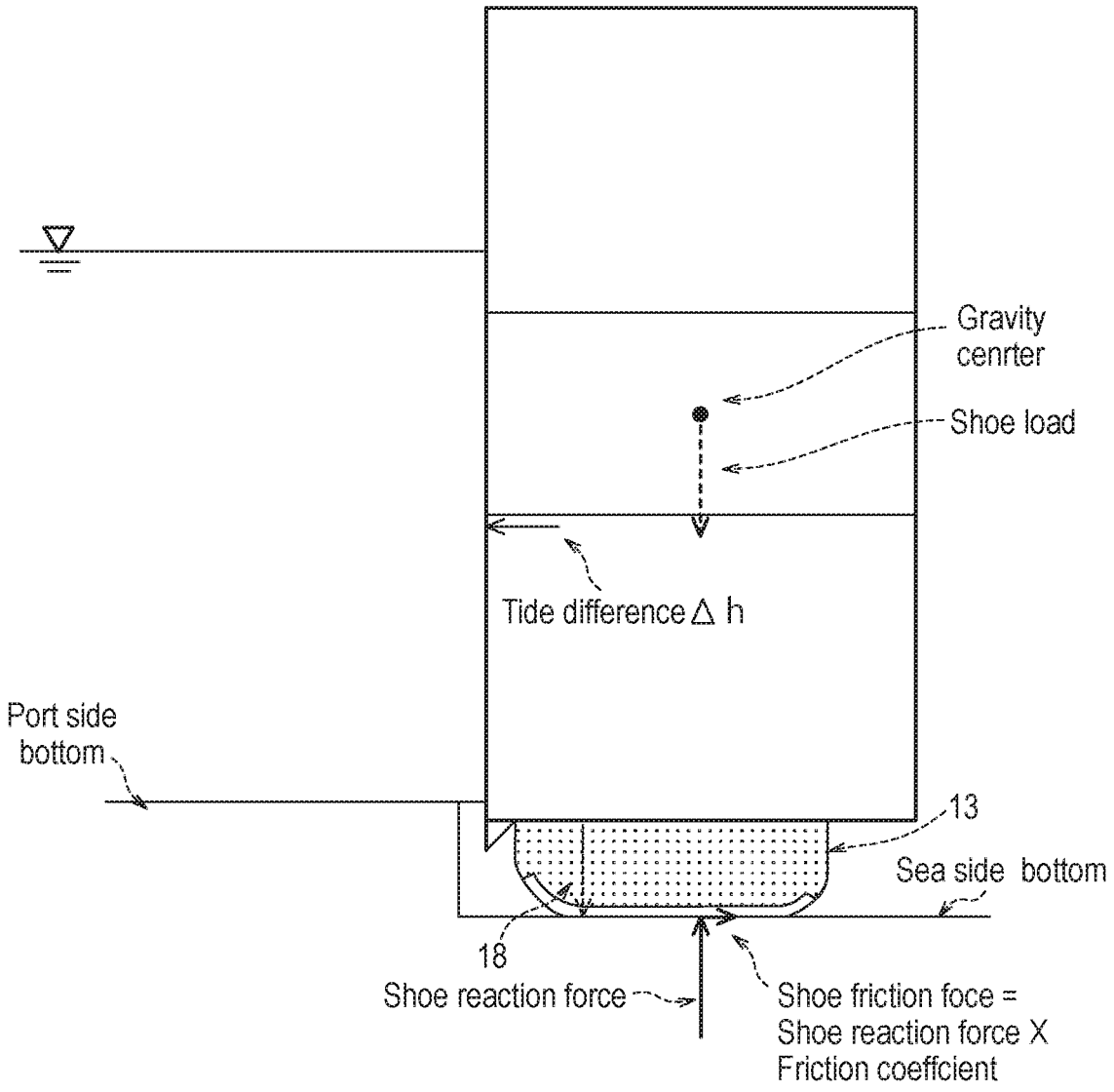
FIG. 10 an explanatory drawing of the friction shoe and is an external force acting drawing before inclination.
Figure 11:
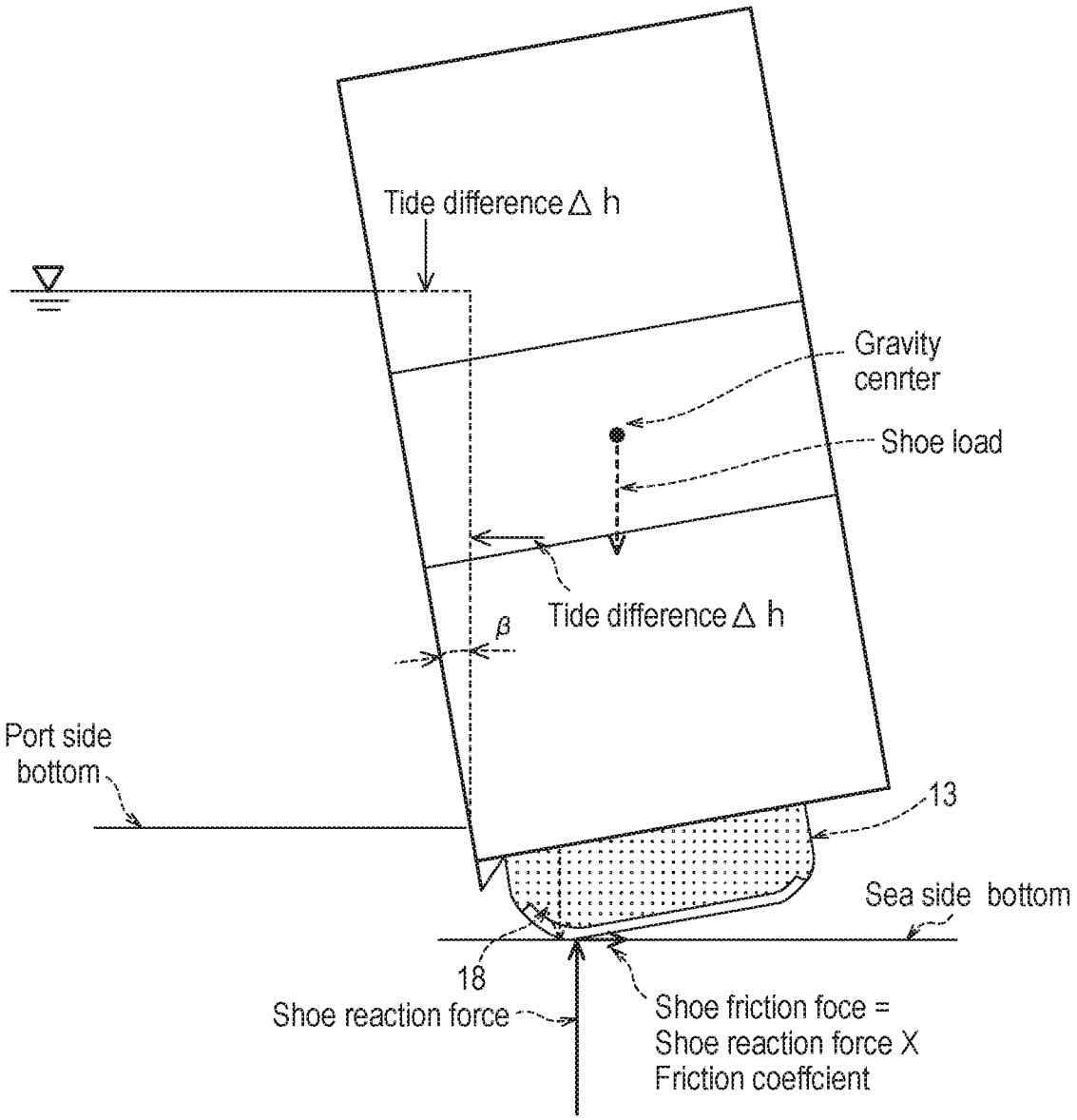
FIG. 11 an explanatory drawing of the friction shoe and is an external force acting drawing after inclination.

FIGS. 10 and 11 illustrate a gate leaf on which a couple consisting of the tide difference Δ h and the shoe friction force is working and FIG. 10 is the gate leaf before inclination emerges and FIG. 11 is after inclination emerges. The shoe reaction force and the shoe friction force (=Shoe reaction force×Friction coefficient) of FIG. 10 work on the point right below the shoe load working at the gravity center and these of FIG. 11 have removed to the position of the radius 18. A horizontal component and a vertical component of the tide difference Δ h work on the gate leaf due to the inclination of β°. Consequently, the vertical component of the tide difference Δ h is added to the shoe reaction force and the shoe friction force. The gate leaf stays at the inclination angle of β° in the state that the inclination moment composed of a coupling which consists of the horizontal component of the tide difference Δ h and the shoe friction force and a coupling which consists of the vertical component of the tide difference Δ h and the shoe reaction force consorts with the upright moment composed of a coupling which consists of the shoe load and the shoe reaction force and a coupling which consists of the pulling-up force S and the upright buoyancy. In addition, the inclination would not emerge when the friction coefficient is small (for instance, the friction coefficient <0.3) because a coupling of the shoe load and the shoe reaction force is predominantly grater than a coupling of the shoe friction force and the horizontal component of the tide difference Δ h and the gate leaf removes up, to the completely closed position keeping upright state (corresponding to previously mentioned "Problem (3.1): Gate leaf lateral inclination").

There can be many shoe tread forms with which the gate leaf can remove keeping upright state or small inclination angle β°. FIG. 12 illustrates the examples. The form combination items of the examples are both ends or one end of a bend side, vertical or inclined of a end wall form and a circular arc or a free curve of a bent form, and a common appearance of all the combinations is the tip 17 of convex curvature form.

Tidal flows in the world excluding special geographies as seen at Seto Inland Sea etc. are between 1.0 and 3.0 Kt (≈0.5 and 1.5 m/s) in general. The gate leaf closing operation in tidal flow, in short, the operation in tidal flow is made at flow speed of this level.

Figures 13, 14:
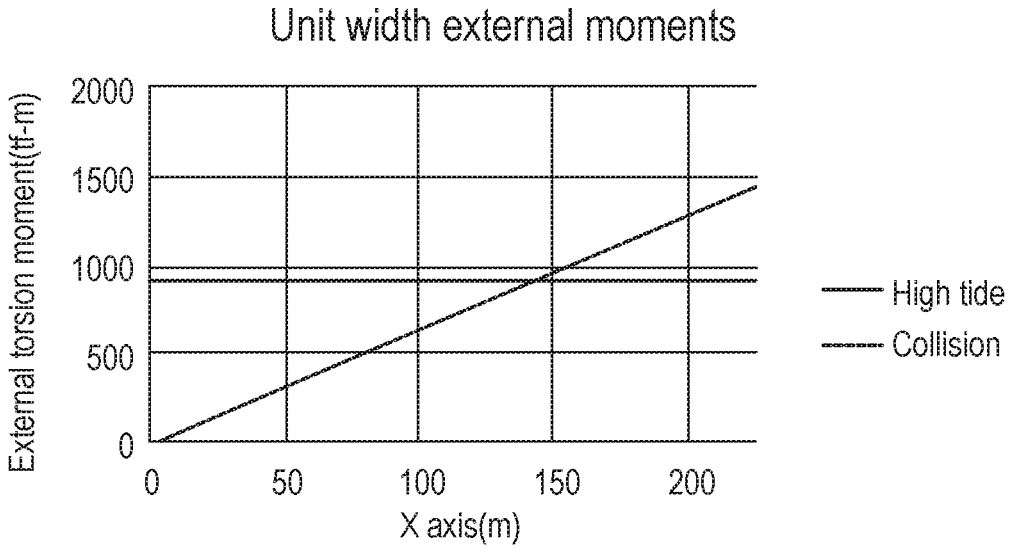
FIG. 13 is external moment (torsion moment) working on gate leaf unit width.
FIG. 14 is a control limit of a side thruster.

FIG. 13 illustrates external moments (torsion moments) working on unit width of the gate leaf during a high tide and at a collision during the operation in tidal flow. They are results of calculation based on the data of FIG. 3. The external load at a collision is inertia force of the gate leaf and its virtual mass and the magnitude of inertia force has been so determined that strain energy resulted in the gate leaf may equal strain energy accumulated in the gate leaf during a high tide. Suppose the strain energy during a high tide corresponds to yield stress, the corresponding external moment during a collision will be the structural limit of the gate leaf and it is calculated on the moment that the gate leaf tip speed is between 1 and 1.5 m/s and the impact force on the gate leaf bottom support seat is 321 tf/m. The width of calculated speed is due to difference of the virtual mass considered.

It is estimated that there may be a case where a reduction of tidal flow energy becomes necessary to avoid the gate damage during the operation in tidal flow. Its means are the friction force of friction shoe, a side thruster, a tug-boat etc. The friction force will be 107 ft in the case that the shoe load is 1074 tf and the friction coefficient is 0.1. FIG. 14 is an example of control limit of gate leaf mounting type side thrusters and shows control limits of keeping the gate leaf in rest state by flow velocity and tide difference.

FIG. 15 is a plan of a gate leaf installation site and illustrates a bottom mounting position, a totally closed position, a bottom mounting angle θc a direction of tidal flow, and, a swing center for the operation in tidal flow.

FIG. 16 is a gate leaf closing step of the operation in tidal flow. As the friction force of Step 2=the friction load×the friction coefficient and the shoe load=1074−the operation buoyancy, the intensity of friction force is selected by a proper selection of the operation buoyancy. The operation buoyancy selection is made according to a selection chart. The selection chart will be prepared according to results of a hydraulic model experiment and a prototype verification test carried out at every project. The tidal flow level, the gate leaf collision velocity and the energy dissipation level are shown at [0041] thru [0043] where kinetic energy of the gate leaf which arrives at the totally closed position is maintained at lower than the limit value by following the closing operation steps of FIG. 16 and gate leaf damage and destructive impact force eruption are avoided due to the kinetic energy transfer to the strain energy there (corresponding to previously mentioned "Problem (3.2): Impact energy").

The step 3 of FIG. 16 indicates a gate leaf move by tidal flow force. Although the tidal flow force is being dissipated by the friction force and conveys the gate leaf up to the completely closed position where the gate leaf keeps its velocity less than or equal to the limited value, a gate leaf tip speed sensing during the operation and, if necessary, a limit speed keeping by side thrusters etc. are required since the friction force=the shoe load×the friction coefficient and the friction coefficient may vary across the ages. And after the gate levitation prevent apparatus is set on at the step 8, appropriate buoyancy is given to the gate leaf by air filling into the operation tank in order to provide for a open operation by tidal flow in reverse direction due to tide level lowering.

Embodiment 2

FIG. 17 is another example of the swing center support mechanism which is shown on FIG. 8 and while FIG. 8 shows an example which satisfies the support condition of rotation free and moving constraint in three axes directions, FIG. 17 shows an example which satisfies the support condition of rotation free in two axes directions A1 and A3 (sec FIG. 17A) and moving constraint in three axes directions A1, A2, and A3.

Figure 17B:
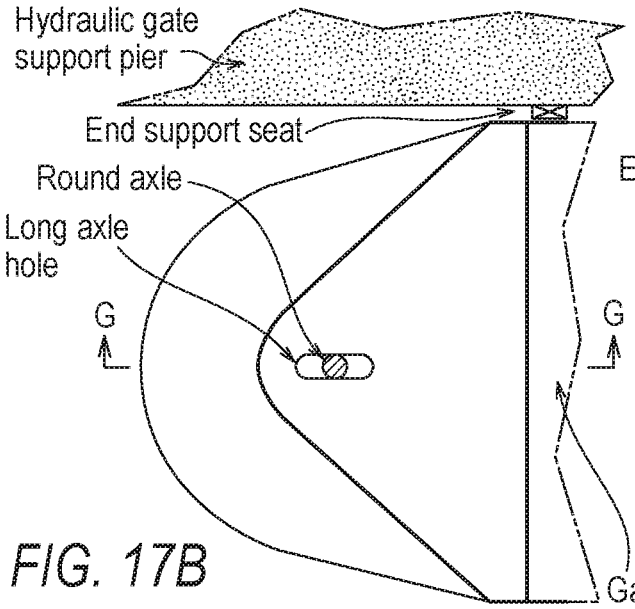
FIG. 17 is an explanatory drawing of a swing center support mechanism of Embodiment 2.
Figure 17A:
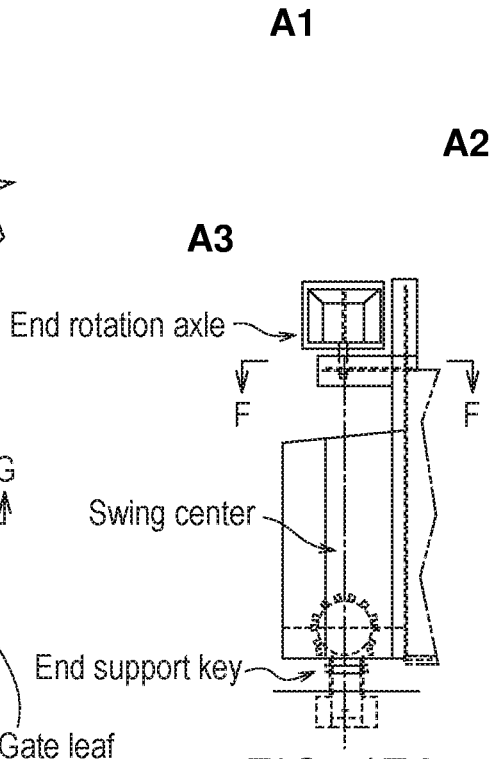
Figure 17C:
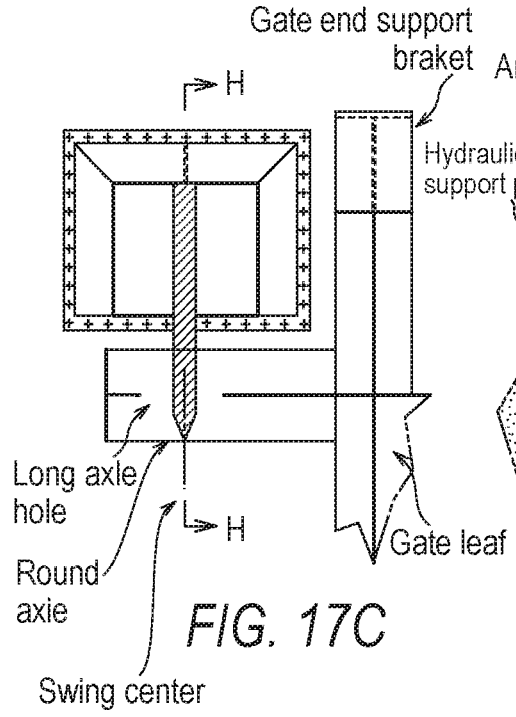
Figure 17D:
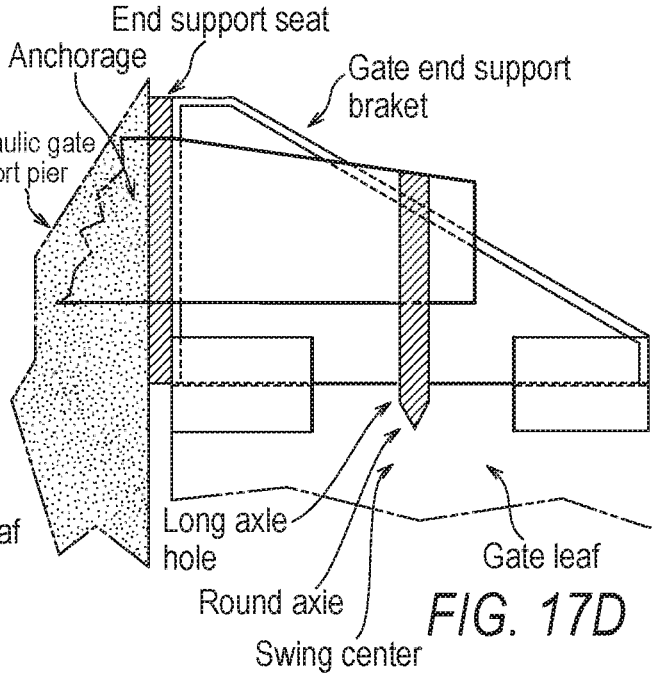

FIG. 17A is an elevation of the swing center support mechanism 11. FIG. 17B is FF section of FIG. 17A. FIG. 17C is GG section of FIG. 17B. FIG. 17D is HH section of FIG. 17C. The end rotation axle of FIG. 17A is a mechanism which is added to FIG. 8A and FIG. 17B thru 17D shows details of the end rotation axle. For a detail of the end support key of FIG. 17A, the details of end support key shown on FIG. 8B thru 8E are applicable. As shown on FIG. 17B, the round axle is fixed on the hydraulic gate support pier, the long axle hole is fixed on the gate leaf side and the round axle is set by being inserted into the long axle hole. FIG. 17C shows the long axle hole fixed on the gate leaf side and the round axle set by being inserted into the long axle hole. A center line of the round axle coincides with the swing center. FIG. 17D shows the state of the round axle which is fixed on the hydraulic gate support pier is set by being inserted into the long axle hole which is fixed on the gate leaf. For reference, the longer diameter of the long axle hole coincides with direction by which pitching motion of the gate leaf around the end support mechanism is allowed and the diameter in the direction of restricting gate leaf rolling which is at right angle motion to the pitching is just a bit bigger than the round axle diameter so that the impact load and hydraulic load working on the gate leaf during completely closed term may be supported by the end support key and the end support bracket.

The gate leaf during swing motion floats on water only by the backup buoyancy of the operation tank which is shown on FIG. 6. Water of the same quantity as the backup buoyancy (1126 tf) is poured into the operation tank after gate leaf 7 of FIG. 4 arrives at the position of the gate leaf 6 in completely closed state, then the tank buoyancy—the pulling-up force S=9000 tf which consorts with the gate leaf weight W. If the gate leaf 7 is softly pushed down in this instant of time a free end of the gate leaf 7 starts to sink, the friction shoe 13 on FIG. 4 arrives at a water bottom (the bottom mounting), and the gate leaf 7 is fit in the position of the gate leaf 6 on FIG. 4. A load of the friction shoe 13 in this state is zero. The load of friction shoe 13 becomes 1074 tf when additional water quantity poured into the operation tank arrives at the tank buoyancy (1074 tf). Although overturn moment of the gate leaf 6 at this time is linear to the shoe load, overturn of the gate leaf 6 will be avoided without the aid of the upright moment of pulling-up force S since the overturn is restricted by the round axle of FIG. 17 (corresponding to previously mentioned "Problem 1: Gate leaf stability at gate mounting on a water bottom").

Pendulum of the gate leaf during its swing motion in ocean waves is rolling, pitching, dipping etc. The pendulum motion of the gate leaf has a rotation element and a removing element at a support point of the swing center support mechanism 11. Although the removing element is restricted by the support point of the three axes direction moving constraint, the rotation element of the pitching is not restricted by the support point of the two axes direction rotation free and a part of the dipping is transferred to a pitching motion. Although big rolling is restricted by the round axle of FIG. 17 whose impact on structural strength may slightly increase, the impact can be mitigated by an appropriate consideration since restriction force of the rolling is small (corresponding to previously mentioned "Problem 2: Gate leaf motion at gate open and closure operation").

Although an inclination moment works on the gate leaf due to a coupling of the horizontal component of the tide difference Δ h and the shoe friction force and a coupling of the vertical component of the tide difference Δ h and the shoe reaction force when the gate leaf is operated with the aid of the tide difference Δ h, the gate leaf removes up to the completely closed position keeping upright state since a big inclination is restricted by the round axle of FIG. 17 (corresponding to previously mentioned "Problem (3.1): Gate leaf lateral inclination").

Embodiment 3

Figure 18A:
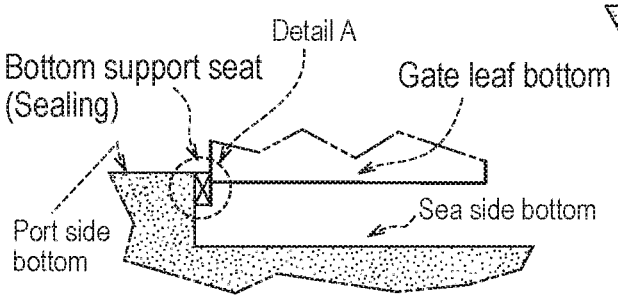
FIG. 18 is an explanatory drawing of a bottom support seat of Embodiment 3.
Figure 18B:
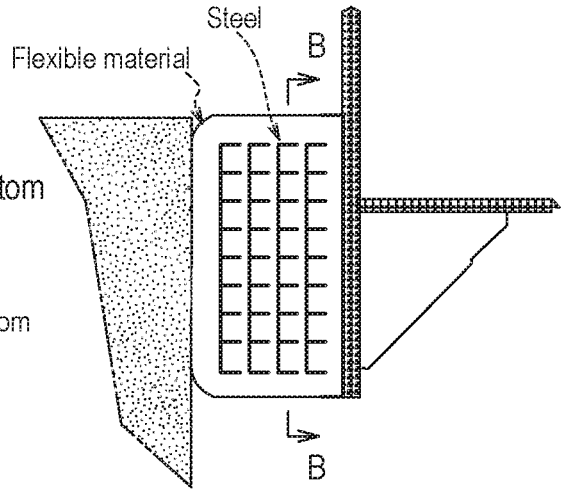
Figure 18C:
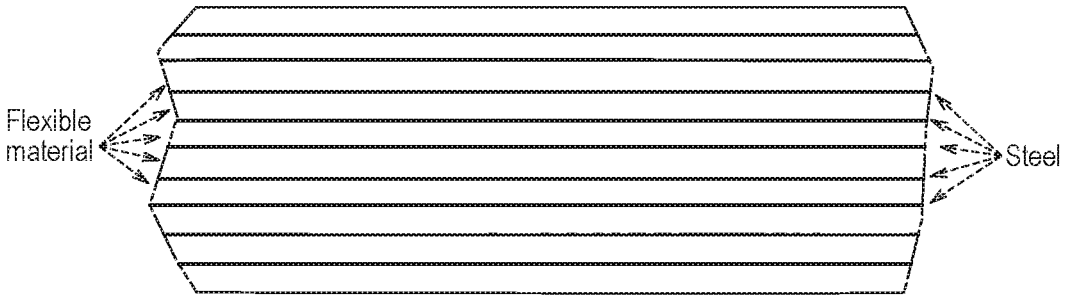

FIG. 18 shows an example of the bottom support seat which provides both flexibility and high strength. FIG. 18A illustrates relative position of the bottom support seat and the gate leaf bottom. FIG. 18B is the detail A of FIG. 18A. FIG. 18C is BB section of FIG. 18B.

A gate leaf portion which hits the concrete structure of the port side sea bottom is the bottom support seat when the gate leaf is operated with the aid of the tide difference Δh and the support seat is subject to a impact power created by a start of gate leaf section rotation at once after the hitting and the reaction force associated with transformation of kinetic energy to strain energy. The reaction force correspond to the inertia force and start by zero and arrives at its maximum value when the energy transformation completes. The support seat needs flexibility as well as high strength owing to accept forces of different kinds. FIG. 18B illustrates the state that a still material like steel etc. is embedded in a flexible material like rubber etc. FIG. 18C illustrates the state that the flexible material and the stiff material continue in a gate leaf length direction. The support seat keeps the flexibility due to this construction. When a flexible material is subject a compression, the inside flexible material surrounded by stiff material approaches to a state of three axial stress (hydrostatic stress). Material has a tendency to get higher yield point when its stress distribution approaches to a status of the hydrostatic stress. For instance, this phenomena is a back ground of a roller and a rail whose contact surface stress is bigger than their braking strength. The impact power created by a start, of gate leaf section rotation is mitigated by the flexibility of the initial stage of the hitting and the big reaction force of the inertia force is absorbed by the high strength after compressed (corresponding to previously mentioned "Problem 4: Reaction force and impact force on a gate leaf bottom support seat").

EXPLANATION OF REFERENCE NUMERALS

1: gate leaf (solid line, in a completely closed state) (flap)
2: gate leaf (dotted line, in a completely opened state) (flap)
3: rotation center (flap)
4: concrete structure (flap)
5: wood seat (flap)
6: gate leaf (solid line, in a completely closed state) (swing)
7: gate leaf (dotted line, in a completely opened state) (swing)
8: swing center
9: storage pier (swing)
10: center line of the tidal sluice gate (swing)
11: swing center support mechanism
12: side thruster
13: friction shoe
14: upper (friction shoe)
15: wear-resistant material (friction shoe)
16: bottom support seat (sealing)
17: tip (wear-resistant material)
18: are radius (tip)

The invention claimed is:

1. A sluice gate comprising a door mounted vertical to water flow or vertical to the course of boats and ships, said door being moored in a storage position when said gate is completely opened, and said door moving to a completely closed position in a floating state when said gate is completely closed by swing motion about an axis, said axis extending vertically to a horizontal water surface, characterized in that said door has a support point fixed to the water bottom beneath a lowermost surface of the sluice gate, and the door is freely rotatable about three axes at the support point and is restricted from translational motion in three axis directions at the support point.

2. The sluice gate according to claim 1, characterized in that during the operation of said sluice gate, a pulling force is applied on said support point.

3. The sluice gate according to claim 1, characterized in that the bottom of said door comprises a friction shoe, wherein the tread tip of said friction shoe has a convex curvature form.

4. The sluice gate according to claim 1, characterized in comprising a bottom support seat provided at a location where said door contacts a structure on the port side sea bottom, wherein said bottom support seat is structured to be flexible and highly strong by embedding a steel material inside a soft material.

5. The sluice gate according to claim 1, wherein the support conditions of said support point are freely rotatable about three perpendicular axes and restricting motion in three perpendicular axis directions.

6. The sluice gate according to claim 1, wherein the sluice gate comprises a spherical seat provided in the lowermost surface of the sluice gate, and wherein a spherical head fixed to the water bottom is positioned within the spherical seat.

7. A sluice gate comprising a door mounted vertical to water flow or vertical to the course of boats and ships, said door being moored in a storage position when said gate is completely opened, and said door moving to a completely closed position in a floating state when said gate is completely closed by swing motion about an axis, said axis extending vertically to a horizontal water surface, characterized in that said door has support points fixed to the water bottom beneath a lowermost surface of the sluice gate and to an upper portion of said door, and said support points have a common central axis, and the door is freely rotatable about two axes at a lower support point of the support points and is restricted from translational motion in three axis directions at the lower support point.

8. The sluice gate according to claim 7, wherein the support conditions of said support point are freely rotatable about two perpendicular axes and restricting motion in three perpendicular axis directions.

* * * * *